US007364097B2

(12) United States Patent
Okuma

(10) Patent No.: US 7,364,097 B2
(45) Date of Patent: Apr. 29, 2008

(54) SHOWER HEAD

(76) Inventor: Yoji Okuma, 2388-30 Oaza-Nakatsubaru, Kawara-machi, Tagawa-gun, Fukuoka 822-1405 (JP)

( * ) Notice: Subject to any disclaimer, the term of this patent is extended or adjusted under 35 U.S.C. 154(b) by 0 days.

(21) Appl. No.: 11/281,705

(22) Filed: Nov. 18, 2005

(65) Prior Publication Data

US 2006/0219821 A1 Oct. 5, 2006

(30) Foreign Application Priority Data

Mar. 15, 2005 (JP) ..... 2005-073393
Sep. 30, 2005 (JP) ..... 2005-287989

(51) Int. Cl.
*B05B 9/08* (2006.01)

(52) U.S. Cl. ..... 239/530; 239/525; 239/556; 239/558; 239/562; 239/590

(58) Field of Classification Search ..... 239/390, 239/396, 533.12, 548, 456, 525, 558, 589, 239/592–594, 428.5, 518, 521, 523, 461, 239/530, 556, 562, 590, 393, 442–445; 222/190
See application file for complete search history.

(56) References Cited

U.S. PATENT DOCUMENTS

| | | | | |
|---|---|---|---|---|
| RE25,447 | E * | 9/1963 | Hjulian | 239/428.5 |
| 3,138,332 | A * | 6/1964 | Hinderer | 239/427 |
| 4,135,670 | A * | 1/1979 | Sugimoto | 239/428.5 |
| 4,184,638 | A | 1/1980 | Ogasawara et al. | |
| 4,666,085 | A * | 5/1987 | Liaw | 239/394 |
| 6,267,301 | B1 * | 7/2001 | Haruch | 239/290 |
| 6,739,527 | B1 | 5/2004 | Chung | |
| 6,852,236 | B2 * | 2/2005 | Holt et al. | 210/748 |
| 6,905,082 | B1 * | 6/2005 | Wu | 239/436 |
| 7,044,405 | B2 * | 5/2006 | Kawazoe et al. | 239/533.12 |

FOREIGN PATENT DOCUMENTS

| | | | |
|---|---|---|---|
| EP | 1 232 801 | | 8/2002 |
| GB | 2088246 | A * | 6/1982 |
| JP | 06-24067 | U | 3/1994 |
| JP | 2670509 | B2 | 7/1997 |
| JP | 11-057535 | A | 3/1999 |
| JP | 2005319449 | A * | 11/2005 |

OTHER PUBLICATIONS

European Search Report dated Oct. 9, 2006 of EP 05026520.6.

* cited by examiner

*Primary Examiner*—Kevin Shaver
*Assistant Examiner*—Jason Boeckmann
(74) *Attorney, Agent, or Firm*—Westerman, Hattori, Daniels & Adrian, LLP.

(57) ABSTRACT

A water-saving type shower head operable to reduce flow volume while maintaining a high discharge pressure. A diameter-reduced water passage 19 of a flow control member 20 disposed in a head portion 22 of a shower head body 12 has a first and a second water passage portions 40 and 41 provided on an entry side and an exit side thereof, respectively. The first water passage portion 40 has a small diameter, and the second water passage portion 41 has an inside diameter which is 1.5 to 3 times that of the first water passage portion 40. On an upstream side of the first water passage portion 40, a tapered diameter-reduced portion 43 reduced in diameter in a flow direction is formed, and on a downstream side of the second water passage portion 41, a diameter-increased portion 45 increased in diameter in the flow direction is formed.

9 Claims, 7 Drawing Sheets

SHOWER HEAD

BACKGROUND OF THE INVENTION

1. Field of the Invention

The present invention relates to a water-saving type shower head which is operable to reduce flow volume while maintaining a high discharge pressure of water discharged from the shower head.

2. Description of the Related Prior Art

A conventional shower head has a shower head body and a sprinkler plate which is provided with a number of small holes and disposed in a distal portion of the shower head body. The conventional shower head uses pressure of water (including mixed hot and cold water) supplied from a proximal side of the shower head to discharge water from the sprinkler plate. Accordingly, strength of the water discharged from the sprinkler plate, i.e. speed of the water spurt from the small holes in the plate, depends on water pressure inside the shower head body. If the water has pressure within a range of standard values of normal tap water pressure, the water is showered at sufficient speed. However, if the tap water pressure is decreased due to enforcement of water restriction etc., power of the discharged water is extremely reduced. Moreover, if a faucet to which the shower head is connected is turned down to save water, the pressure inside the shower head body is lowered, which extremely weakens strength of the water discharged from the sprinkler plate.

In view of the above circumstances, Japanese Patent Gazette No. 2670509 proposes a water-saving type shower head in which a flow control member having a diameter-reduced water passage portion is provided on an upstream side of a sprinkler plate. The diameter-reduced water passage portion of the water-saving type shower head has a tapered diameter-reduced portion reduced in diameter in a flow direction and a diameter-increased portion increased in diameter in the flow direction which are disposed on an entry side and an exit side of the diameter-reduced water passage portion, respectively. Water is accelerated when passing through the diameter-reduced water passage portion. Moreover, the exit side of the diameter-reduced water passage portion is increased in diameter. Accordingly, the accelerated water is impinged on the sprinkler plate having a relatively large area without decreasing kinetic energy of the water.

Although the invention of Japanese Patent Gazette No. 2670509 is capable of enhancing discharge pressure of the water discharged from the sprinkler plate of the shower head, flow volume of the discharged water is high because the diameter-reduced water passage portion has a large diameter. This brings about a problem that shower water hits a user's skin hard and gives slight pain when the shower is used. If the diameter of the diameter-reduced water passage portion is simply reduced to solve the problem, passage resistance of water is increased, which not only decreases flow volume of water but also generates pressure loss in water flow. This brings about another problem that shower water having prescribed force cannot be obtained.

SUMMARY OF THE INVENTION

The present invention has been made in view of the above problems of the prior art, and it is an object of the present invention to provide a water-saving type shower head which is operable to reduce an amount of discharge water while maintaining power of shower water.

According to a first invention for attaining the above object, there is provided a shower head comprising: a shower head body having a cylindrical water passage and an inflected water passage connected to the cylindrical water passage, the passages being provided inside the shower head body from a proximal portion thereof having a water inlet through a head portion thereof; a sprinkler cap having a ring-shaped cap body and a sprinkler plate, the cap body having a fitting opening formed in a central portion of the cap body and being fixed to the head portion of the shower head body via a screw mechanism, the sprinkler plate having a plurality of sprinkler holes and being secured to the fitting opening; and a flow control member having a diameter-reduced water passage and being placed on an upstream side of the sprinkler plate; wherein the diameter-reduced water passage has a first water passage portion with a small diameter and a second water passage portion respectively provided on an entry side and an exit side of the diameter-reduced water passage, the first water passage portion having a cross-sectional area smaller than those of the cylindrical water passage and the inflected water passage of the shower head body, the second water passage portion having an inside diameter which is 1.5 to 3 times that of the first water passage portion; and a tapered diameter-reduced portion, reduced in diameter in a flow direction and communicated with the inflected water passage, is formed on an upstream side of the first water passage portion, and a diameter-increased portion increased in diameter in the flow direction is formed on a downstream side of the second water passage portion; whereby the flow control member reduces volume of water and generates substantially uniform water pressure distribution radially on an immediately upstream side of the sprinkler cap.

In the shower head according to the first invention, the shower head body may be hand-held type (e.g., wall-hung type) or wall fixed type. It is preferable that the shower head body, the sprinkler cap and the flow control member are made of a hard synthetic resin with good formability such as heat-resistant ABS (acrylonitrile butadiene styrene), PP (polypropylene), vinyl chloride, or PC (polycarbonate). Furthermore, it is preferable that a packing made of rubber or a synthetic resin is used for prevention of a water leak (i.e., for maintenance of water tightness). The diameter-reduced water passage includes the first and the second water passage portions. The first water passage portion formed on the entry side of the diameter-reduced water passage has the cross-sectional area smaller (e.g., 0.063 to 0.15 times) than those of the cylindrical water passage and the inflected water passage of the shower head body, thereby reducing volume of water and increasing flow rate of the water. The cylindrical water passage and the inflected water passage located downstream thereof are circular, rectangular (including square), or polygonal in cross section.

Given that the inside diameter of the first water passage portion is "d", the inside diameter of the second water passage portion is in a range of 1.5d to 3d. If the inside diameter of the second water passage portion is less than 1.5 times the inside diameter "d" of the first water passage portion, water flow having passed through the second water passage portion concentrates on the center of the sprinkler plate, and pressure of the water concentrates on the upstream side of the sprinkler cap. Accordingly, the water is not impinged on the entire sprinkler plate evenly, and thereby the water is not uniformly discharged from the plurality of the sprinkler holes disposed in the sprinkler plate. If the inside diameter of the second water passage portion exceeds 3 times the inside diameter "d" of the first water passage portion, the water accelerated by the first water passage portion spreads in the second water passage portion so widely that force of the shower water discharged from the sprinkler holes of the sprinkler plate is weakened. In this case, when the water having passed through the first water passage portion has a high flow rate, the water does not come in contact with an inner wall of the second water passage portion, and thereby the water does not hit the sprinkler plate extensively.

In the shower head according to the first invention, the first water passage portion with the small diameter, which has the cross-sectional area smaller than those of the cylindrical water passage and the inflected water passage, is provided at the entry side of the diameter-reduced water passage, thereby rapidly enhancing the flow rate of the water fed therein. Furthermore, the second water passage portion having the inside diameter which is 1.5 to 3 times that of the first water passage portion is provided on the exit side of the diameter-reduced water passage, thereby allowing the accelerated water to be impinged on the sprinkler plate without decreasing kinetic energy of the water. Still furthermore, the tapered diameter-reduced portion, reduced in diameter in the flow direction, is formed on the upstream side of the first water passage portion, thereby allowing the water supplied to the cylindrical and inflected water passages of the shower head body to be efficiently taken in the first water passage portion. Yet furthermore, the diameter-increased portion, increased in diameter in the flow direction, is formed on the downstream side of the second water passage portion. Thereby, the water can be discharged from the diameter-increased portion while spreading gradually, and the water with substantially even water pressure distribution in a radial direction can be generated on the immediately upstream side of the sprinkler cap.

According to a second invention, in the shower head according to the first invention, a partition plate having at least one through-hole is disposed between the flow control member and the sprinkler plate so as to divide space therebetween into a first chamber and a second chamber from an upstream side to a downstream side. By such a structure, the force of the water is once restrained in the first chamber, and thereby the water discharge pressure can be lowered. Moreover, when mixed hot and cold water is supplied, the water can be uniformly mixed in the first chamber.

Here, it is preferable that one through-hole is eccentrically disposed in the partition plate. According to the structure, cavitation is more efficiently generated by the water flow flowing in the first chamber. In this case, it is preferable that a diameter of the through-hole is 0.08 to 0.14 times that of the partition plate and the center of the through-hole is eccentrically located in distance of 0.5 to 0.8 times a radius of the partition plate from the center of the partition plate.

According to a third invention, in the shower head according to the second invention, a silver ion generating material in a solid form is disposed in the first chamber. Thus, silver ions from the silver ion generating material dissolve in water discharged from the second water passage portion with the water flowing in the first chamber to be discharged from the through-hole of the partition plate, thereby promoting sterilization of the water. As the silver ion generating material, for instance, one or more of a silver-coated porous ceramic pellet produced by combustion synthesis, a synthetic resin having silver powder, a solidified substance plated with silver, solid silver, etc. may be used. Especially when the first chamber is made to have a structure to actively generate cavitation, silver ions are generated more effectively from the silver ion generating material.

According to a fourth invention, in the shower head according to the first to third inventions, the sprinkler plate is made of a circular plate having an outer wall gradually increased in diameter in the flow direction and conforming to an inner wall of the cap body, and the sprinkler holes include a plurality of inner sprinkler holes and a plurality of outer sprinkler holes, the inner sprinkler holes being formed in an inner portion of the sprinkler plate except a periphery thereof and extending in parallel to an axis of the sprinkler cap, the outer sprinkler holes being formed by a plurality of grooves and the inner wall of the cap body, each of the grooves having an arc-shaped or a U-shaped cross section with an outer side thereof opened and being provided in the outer wall of the sprinkler plate. In the shower head according to the fourth invention, the water flowing from the outer sprinkler holes encircles the water flowing from the inner sprinkler holes, and thus more uniform shower water is formed. Moreover, since the grooves forming the outer sprinkler holes have the cross section in an arc-shape or a U-shape, the outer sprinkler holes having a uniform cross-sectional area are easily formed, and also the water hardly adheres to the outer sprinkler holes, which consequently prevents adhesion of calcium etc.

In the shower head according to the fourth invention, a straight portion in a central portion of each of the inner sprinkler holes may have a length that is 0.6 to 1.2 times an inside diameter of the straight portion, and each of the inner sprinkler holes may have a water entry portion and a water exit portion, the water entry portion being gradually reduced in diameter in the flow direction to be in a truncated conical shape (i.e., in a tapered shape), the water exit portion being gradually increased in diameter in the flow direction to be in a truncated conical shape (i.e., in an inverse tapered shape). Because of the structure, the water passes through the inner sprinkler holes with reduced pressure loss of the water, and the water flowing in the inner sprinkler holes is discharged while spreading gradually, which provides an advantage that the user hardly feels pain when the water discharged from the inner sprinkler holes is showered on the user's body.

In the shower head according to the first to fourth inventions, a gradually tapered distal portion of the cylindrical water passage and the inflected water passage connected thereto have inner dimensions greater than the inside diameter "d" of the first water passage portion. Each of the inflected water passage and the distal portion of the cylindrical water passage has a cross-sectional area which is, for example, 6.6 to 16 times that of the first water passage portion. Thus, the water flowing in the cylindrical and the inflected water passages of the shower head body is fed into the narrow diameter-reduced water passage, and the flow rate of the water is increased.

The first water passage portion preferably has a length of 1.3d to 2d with respect to the inside diameter "d" of the first water passage portion. If the length of the first water passage portion is less than 1.3 d, the flow rate of the water is not increased sufficiently. On the other hand, if the length exceeds 2d, the water having passed through the first water passage portion is spurt linearly and is not spread in the second water passage portion. As a result, the flow volume of the water is not reduced, and thus a water-saving effect cannot be obtained.

In the shower head according to the first to fourth inventions, the tapered diameter-reduced portion formed on the immediately upstream side of the first water passage portion preferably has an inside diameter of 1.6d to 2.3d on an entry side thereof, a length of 0.4d to 0.5d, and a taper angle (i.e., opening inclination angle to an axis of the diameter-reduced water passage, the same hereunder) of 30 to 45 degrees. Such a structure permits the water fed in the water passages of the shower head to be efficiently taken in the first water passage portion.

The second water passage portion preferably has a length of 2.2d to 3.4d on the basis of the inside diameter "d" of the first water passage portion (the same hereunder). If the length of the second water passage portion is less than 2.2d, the flow volume of the water is not reduced, and thus water-saving effect is not easily obtained. On the other hand, if the length exceeds 3.4d, the water is not spurt extensively, and is impinged on the sprinkler plate linearly.

The diameter-increased portion on an immediately downstream side of the second water passage portion is preferably 0.8d to 1.2d in length, and 30 to 45 degrees in taper angle. Thereby, the water is discharged from the diameter-increased portion while spreading gradually, and the water is impinged on the immediately upstream side of the sprinkler cap with substantially even water pressure distribution in a radial direction.

In the shower head according to the first to fourth inventions, a truncated conical connecting portion gradually increased in diameter in the flow direction is preferably disposed between the first and the second water passage portions. The length of the truncated conical connecting portion is, for example, 0.7d to 1.1d. Since the truncated conical connecting portion is thus provided between the first and the second water passage portions, the water flows smoothly from the first water passage portion to the second passage portion, and vortex or adverse current hardly generates on a border portion between the first and the second water passage portions.

BRIEF DESCRIPTION OF THE DRAWINGS

FIG. 5 (B) is a sectional view of a flow control member according to a modification;

FIG. 5 (C) is a sectional view of a flow control member according to a comparative example;

DETAILED DESCRIPTION OF THE INVENTION

Next, referring to the accompanying drawings, embodiments of the present invention is described for the present invention to be understood.

Referring to FIGS. 1-5 (C), a shower head 10 according to a first embodiment of the present invention will be explained.

Figure 1:
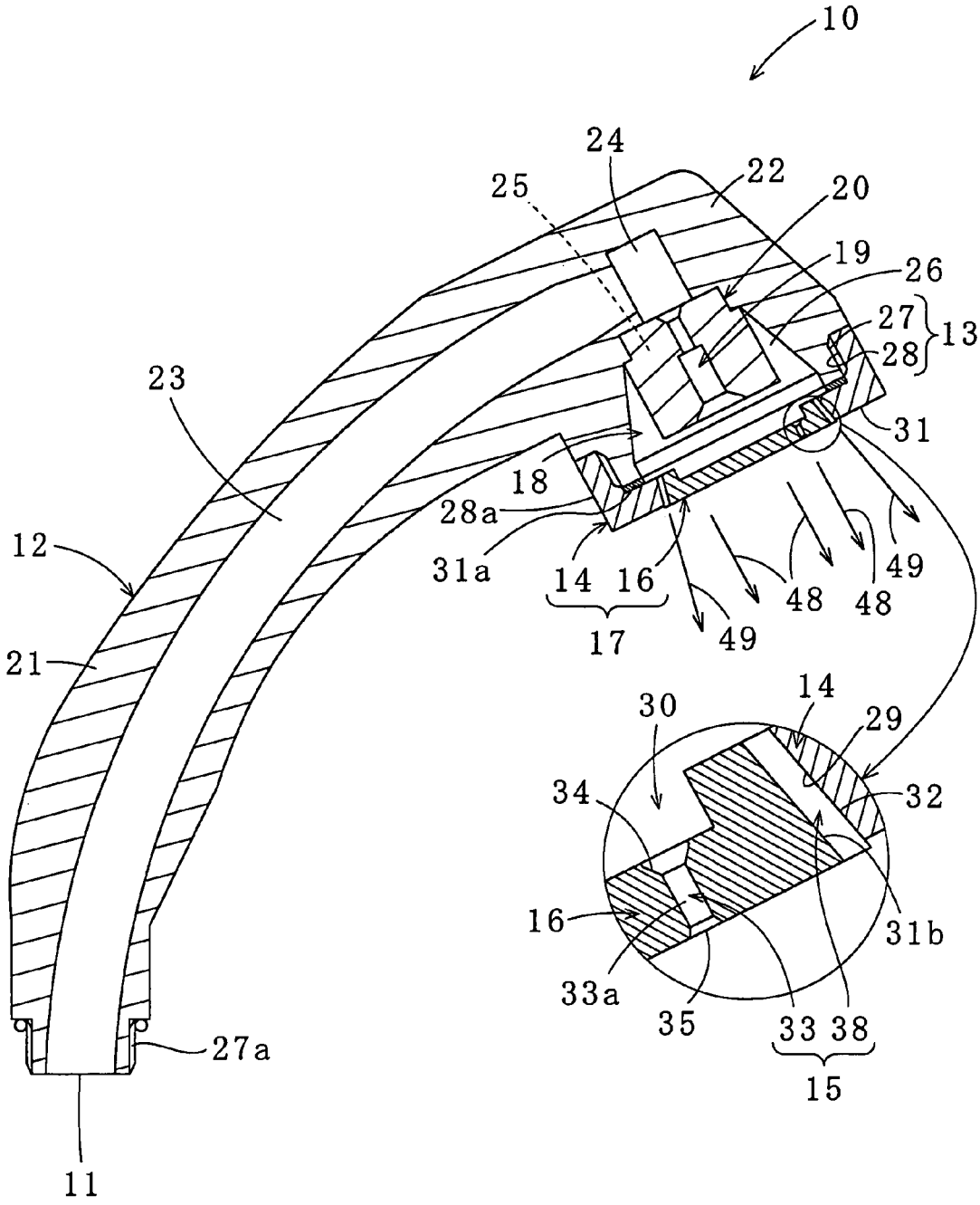
FIG. 1 is a sectional side view of a shower head according to a first embodiment of the present invention.

As illustrated in FIG. 1, the shower head 10 includes a shower head body 12 having a water inlet 11 provided at a proximal portion thereof; and a sprinkler cap 17 having a ring-shaped cap body 14 and a sprinkler plate 16, the cap body 14 being fixed to a head portion 22 of the shower head body 12 via a screw mechanism 13, the sprinkler plate 16 having a plurality of sprinkler holes 15 and being fitted in the cap body 14. A flow control member 20 having a diameter-reduced water passage 19 is disposed in space 18 located upstream of the sprinkler plate 16. According to the structure, the shower head 10 allows water (including mixed hot and cold water, the same hereunder) supplied from the water inlet 11 to be discharged from the sprinkler holes 15 in the sprinkler plate 16. The shower head 12, the sprinkler cap 17, and the flow control member 20 are made of such as an ABS resin having good formability (i.e., an example of hard synthetic resins). Details of each of the above components are explained hereunder.

The shower head body 12 includes a tubular handle portion 21 having the water inlet 11 provided at a proximal portion thereof, and the hollow head portion 22 which is increased in diameter in a flow direction and is integrally formed with the handle portion 21. The handle portion and the head portion which is to be the shower head body may be formed separately, and be connected with each other by a screw mechanism etc. From a proximal portion side to a head portion side inside the shower head body 12, there are provided a cylindrical water passage 23 having a distal portion gradually reduced in diameter; an inflected water passage 24 having a square cross section, which is disposed substantially perpendicular to the cylindrical water passage 23; a cylindrical mounting portion 25 for installing the flow control member 20 therein, which has a diameter larger than a side of the inflected water passage 24 and is linked to the inflected water passage 24; and an enlarged portion 26 which is increased in diameter in the flow direction and is linked integrally to the mounting portion 25. The space 18 is formed in the head portion 22 of the shower head body 12 by the mounting portion 25 and the enlarged portion 26. On an outer side of a distal portion of the head portion 22 in the shower head body 12, a male screw 27 on which the sprinkler cap 17 is screwed is formed. On an outer side of a proximal portion of the shower head body 12, a male screw **27*a*** is formed to be fitted into a joint provided in a distal portion of a hose not shown.

Figure 2:
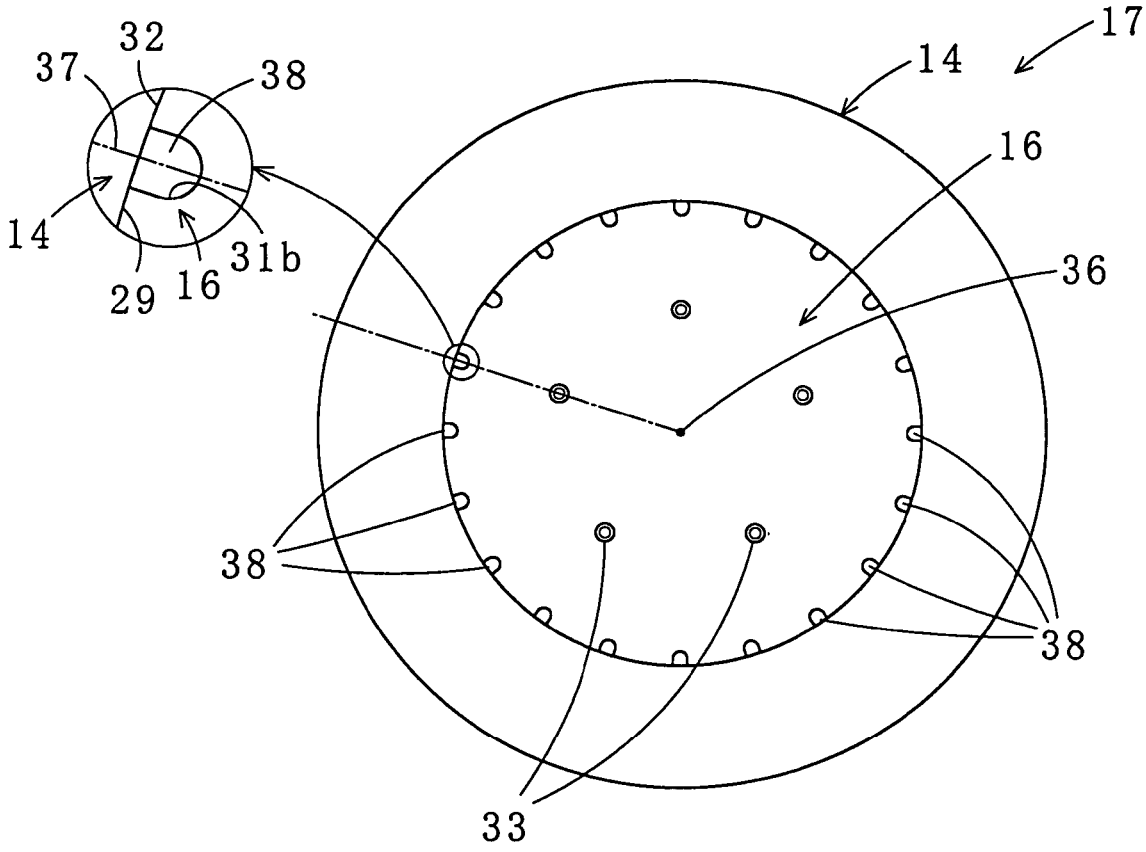
FIG. 2 is a front elevational view of a sprinkler cap of the shower head.
Figure 3:
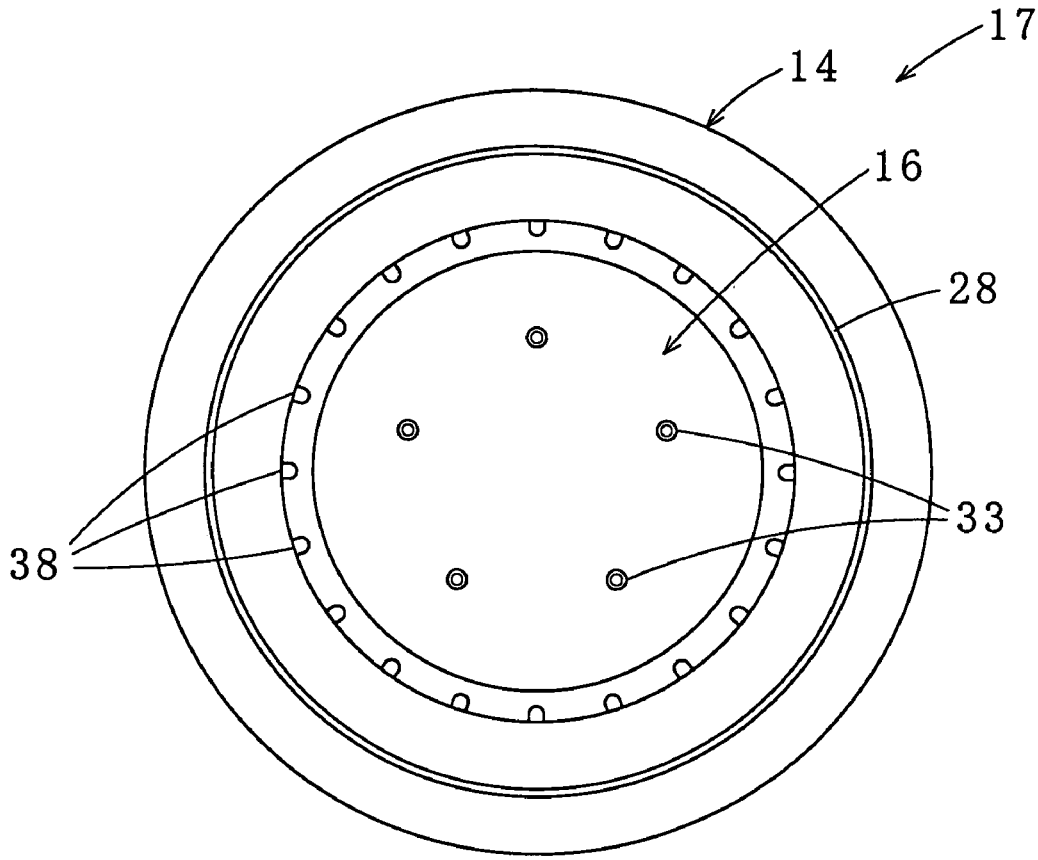
FIG. 3 is a rear elevational view of the sprinkler cap.
Figure 4:
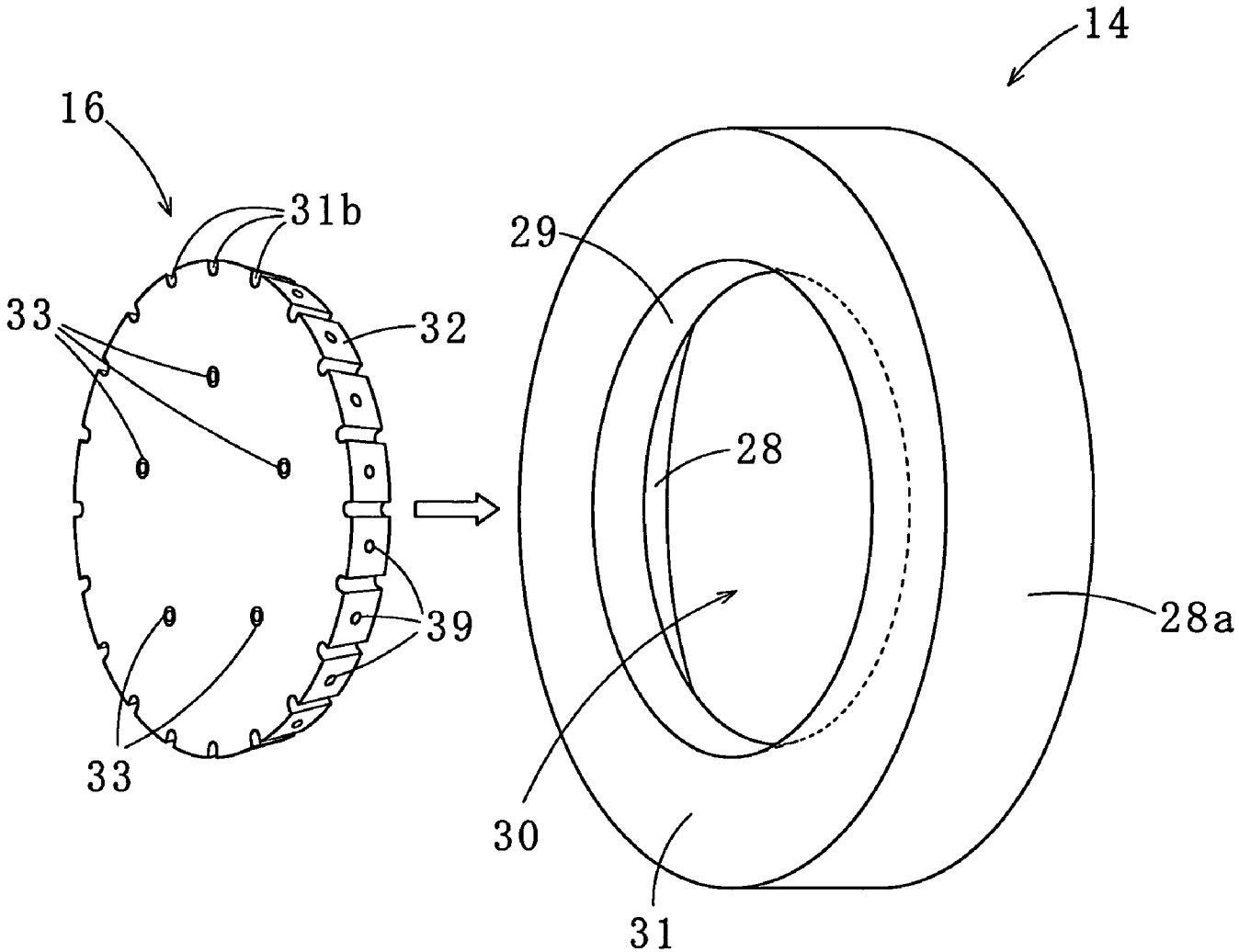
FIG. 4 is an exploded perspective view of the sprinkler cap.

As illustrated in FIGS. 2-4, the cap body 14, a component of the sprinkler cap 17, includes a side wall portion **28*a* and an annular-shaped plate portion 31, the side wall portion 28*a* having a female screw 28 provide inside thereof to be screwed on the male screw 27 of the shower head body 12. On a central side of the plate portion 31, an inverse tapered fitting opening 30 which is gradually increased in diameter in the flow direction is provided. The male screw 27 of the shower head body 12 and the female screw 28 of the cap body 14 constitute the screw mechanism 13. A rubber packing 31*a* is disposed on a tip of the male screw 27 to prevent a water leak (i.e., to maintain water tightness) from a gap between the shower head body 12 and the sprinkler cap 17 which are fixed by the screw mechanism 13**.

The sprinkler plate 16, a component of the sprinkler cap 17, is made of a circular disk having an inverse tapered outer wall 32 gradually increased in diameter in the flow direction. A form of the outer wall 32 is substantially identical to that of an inner wall 29 which forms the inverse tapered fitting opening 30 of the cap body 14. The sprinkler plate 16 is inserted in the fitting opening 30 formed in the central portion of the cap body 14, and is adhered thereto by ultrasonic bonding, an adhesive, or the like.

A plurality of (e.g., five) inner sprinkler holes 33, each of which has a circular cross section and extends parallel to an axis of the sprinkler cap 17, are formed on an inner portion of the sprinkler plate 16 except the periphery thereof. A water entry portion 34 provided in the each of the inner sprinkler holes 33 is reduced in diameter in the flow direction to be in a truncated conical (tapered) shape. Thus, the water entry portion 34 allows the water to be efficiently taken in the each of the inner sprinkler holes 33, and reduces fluid resistance of the inner sprinkler hole 33, with resultant reduction in pressure loss. If a minimum inside diameter (an inside diameter of a non-tapered portion, i.e. a straight portion 33*a* in a central portion) of the each of the inner sprinkler holes 33 is represented as "ϕ" (e.g., 0.35 to 0.8 mm), the water entry portion 34 in the each of the inner sprinkler holes 33 has an inside diameter of 2.4ϕ to 3.7ϕ (e.g., 3.1ϕ) on its entry side, a length of 1.2ϕ to 1.8ϕ (e.g., 1.5ϕ), and taper angle of 30 to 45 degrees (e.g., 35 degrees) to an axis of the sprinkler plate 16. The straight portion 33*a* in the central portion of the each inner sprinkler hole 33 has a length of e.g. 0.6ϕ to 1.2ϕ (preferably, 0.8ϕ to 1.1ϕ).

A water exit portion 35 disposed in the each of the inner sprinkler holes 33 is gradually increased in diameter in the flow direction to be in a truncated conical (inverse tapered) shape. Thereby, without decreasing kinetic energy of the water accelerated by the each of the inner sprinkler holes 33 reduced in diameter, the water exit portion 35 discharges water forcibly while increasing the diameter gradually, and thus a user feels no pain when the water is showered on the user's body. The water exit portion 35 in the each of the inner sprinkler holes 33 has an inside diameter of 1.6ϕ to 2.4ϕ (e.g., 2.0ϕ) on its exit side, and a length of 0.57ϕ to 0.86ϕ (e.g., 0.7ϕ), and a taper angle of 30 to 45 degrees (e.g., 35 degrees).

A plurality of (e.g., 20) grooves 31*b*, which are spaced apart from each other in a circumferential direction of the sprinkler plate 16 and are extended in the flow direction, are disposed on an outer wall 32 in a circumferential portion of the sprinkler plate 16. Each of the grooves 31*b* is symmetric about a straight line 37 radially and outwardly extending from a center 36 of the sprinkler plate 16, and is U-shaped in cross section with an outer side thereof opened. The sprinkler plate 16 is inserted in the fitting opening 30 of the cap body 14 from a distal side thereof, and the outer wall 32 of the sprinkler plate 16 is fixedly secured to the inner wall 29 of the cap body 14. In this manner, 20 outer sprinkler holes 38 are formed by the grooves 31*b* of the sprinkler plate 16 and the inner wall 29 of the cap body 14. Since the grooves 31*b* formed in the sprinkler plate 16 to constitute the outer sprinkler holes 38 are U-shaped with radially outward of the sprinkler plate 16 opened (e.g., the U-shaped groove is 0.7 to 1 mm in width), water droplets hardly remain in the outer sprinkler holes 38, and thereby adhesion of calcium etc. contained in the water supplied to the shower head 10 can be prevented. The sprinkler holes 15 include the inner sprinkler holes 33 and the outer sprinkler holes 38.

In the sprinkler plate 16, thickness of a circumferential portion is thicker than that of a central portion, which makes the outer sprinkler holes 38 longer than the inner sprinkler holes 33 (e.g., 2 to 3 times). Because of this structure, first shower water 48 from the inner sprinkler holes 33 is jetted in parallel to the axis of the sprinkler cap 17 while spreading gradually, and second shower water 49 from the outer sprinkler holes 38 forms curtain-like water stream in a truncated conical form which is increased in diameter in the flow direction centering around the axis of the sprinkler cap 17, i.e., surrounding the first shower water 48 discharged from the inner sprinkler holes 33.

As illustrated in FIG. 4, before being adhered to the fitting opening 30 of the cap body 14, the outer wall 32 of the sprinkler plate 16 is provided with a plurality of projections 39 for welding having a minute height which are spaced apart from each other in the circumferential direction of the sprinkler plate 16. After the sprinkler plate 16 is fitted in the fitting opening 30, ultrasonic vibration is applied to the sprinkler plate 16 to melt the projections 39 for welding, thereby allowing the sprinkler plate 16 to be tightly secured to the inside of the fitting opening 30 with ease. In this instance, as the projections 39 for welding have a minute height, there is no possibility that the outer sprinkler holes 38 are clogged up with the melted projections 39. Alternatively, the sprinkler plate 16 maybe secured to the cap body 14 by a fixing means such as a connecting bolt.

Figure 5A:
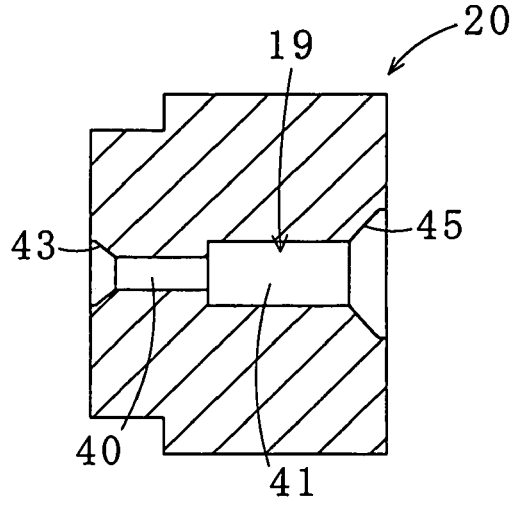
FIG. 5 (A) is a sectional view of a flow control member of the shower head.

As illustrated in FIG. 1, the flow control member 20 is fitted in and fixed to the mounting portion 25, and is disposed in the space 18. As illustrated in FIG. 5(A), the diameter-reduced water passage 19 formed in the flow control member 20 has the first water passage portion 40 with a small diameter provided at an entry side thereof. The first water passage portion 40 is communicated with the inflected water passage 24 of the shower head body 12, and has a cross-sectional area smaller than those of the cylindrical water passage 23 and the inflected water passage 24. In addition, the diameter-reduced water passage 19 has a second water passage portion 41 provided at an exit side thereof. The second water passage portion 41 has an inside diameter of 1.5 to 3 times the inside diameter "d" (e.g., 3 to 4 mm) of the first water passage portion 40 (e.g., 1.7d). A tapered diameter-reduced portion 43 reduced in diameter in the flow direction is formed on an upstream side of the first water passage portion 40. A diameter-increased portion 45 increased in diameter in the flow direction is formed on a downstream side of the second water passage portion 41. The straight portion 33*a* in the central portion of the each sprinkler hole 33 has an inside diameter "ϕ" of about 0.1d to 0.25d, the inside diameter of the straight portion 33*a* being much smaller than the inside diameter "d" of the first water passage portion 40.

The first water passage portion 40 constituting the diameter-reduced water passage 19 has the inside diameter "d" which is smaller than inner dimensions of the inflected water passage 24. Thus, the diameter-reduced water passage 19 is operable to rapidly enhance the flow rate of the supplied water by the first water passage portion 40, and to impinge the accelerated water on the sprinkler plate 16 by the second water passage portion 41 without lowering the water's kinetic energy. A side of the inflected water passage 24 is 2.28d to 3.54d (e.g., 3.2d), and a cross-sectional area thereof is 6.6 to 16 times that of the first water passage portion 40. The first water passage portion 40 has a length of 1.3d to 2.0d (e.g., 1.6d), and the second water passage portion 41 has a length of 2.2d to 3.4d (e.g., 2.8d).

Furthermore, the tapered diameter-reduced portion 43 reduced in diameter in the flow direction is formed on an upstream side of the first water passage portion 40, thereby permitting the water supplied to the inflected water passage 24 in the shower head body 12 to be efficiently taken in the first water passage portion 40. The diameter-increased portion 45 increased in diameter in the flow direction is formed on the downstream side of the second water passage portion 41, thereby permitting the water to be impinged on the sprinkler cap 17 with a substantially even water pressure distribution in a radial direction. The tapered diameter-reduced portion 43 has an inside diameter of 1.6d to 2.3d (e.g., 1.9d) on its entry side, and a length of 0.4d to 0.5d (e.g., 0.4d). The diameter increased portion 45 has a length of 0.8d to 1.2d (e.g., 1.0d), and an opening angle of 30 to 45 degrees with respect to an axis of the diameter-reduced water passage 19.

Figure 5B:
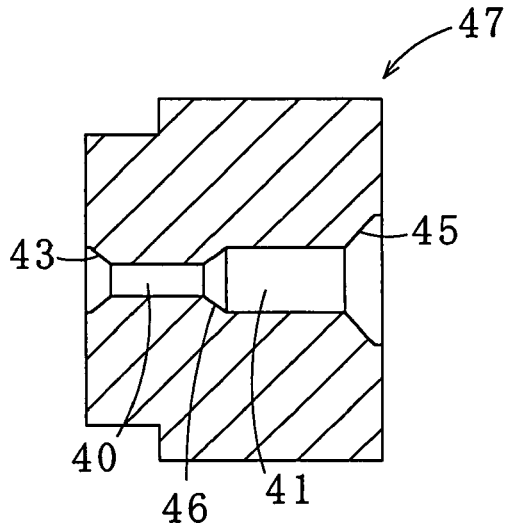

As illustrated in FIG. 5 (B), a flow control member 47 may be employed in place of the flow control member 20. The flow control member 47 has a truncated conical connecting portion 46 which is gradually increased in diameter in the flow direction and is disposed between the first and the second water passage portions 40, 41. The truncated conical connecting portion 46 of the flow control member 47 can prevent a reverse flow of the water from the second water passage portion 41 to the first water passage portion 40. Moreover, in a case where the mixed hot and cold water is supplied, the truncated conical connecting portion 46 can prevent reduction in water temperature. Here, the truncated conical connecting portion 46 has a length of 0.7d to 1.1d (e.g., 0.9d).

Next, a flow of water at the time of using the shower head 10 is explained.

When a faucet or a hot and cold water mixing faucet (not shown) is opened, water having a certain water pressure is supplied to the shower head 10 through a shower hose (not shown). The water thus supplied passes through the water inlet 11, the cylindrical water passage 23, and the inflected water passage 24 of the shower head body 12. Then, the water passes through the tapered diameter-reduced portion 43, the first water passage portion 40, the second water passage portion 41, and the diameter-increased portion 45 of the flow control member 20, and is subsequently supplied to the sprinkler cap 17 via a distal side of the enlarged portion 26.

The water supplied to the sprinkler cap 17 is emitted from the inner and the outer sprinkler holes 33, 38 formed in the sprinkler cap 17 as the first and the second shower water 48, 49, respectively, and is discharged on the user's body. The each of the inner sprinkler holes 33 is disposed in parallel to the axis of the sprinkler cap 17, and the straight portion 33*a* of the each of the sprinkler holes 33 has a short length. Moreover, the water exit portion 35 disposed at the exit side of the each of the inner sprinkler holes 33 is increased in diameter in the flow direction. Accordingly, the water from the inner sprinkler holes 33 is discharged on the user's body while spreading gradually, thereby providing a massaging effect that the water is jetted out on a relatively wide area of the user's skin.

Furthermore, since the each of the inner sprinkler holes 33 is small in diameter, part of the first shower water 48 is discharged in a form of a mist, and might be splashed outwardly deviating from the flow direction if only the first shower water 48 is provided (i.e., if the second shower water 49 explained hereunder is not provided). On the other hand, the second shower water 49 is discharged through the outer sprinkler holes 38, each of which has a cross-sectional area and a length larger than those of the each of the inner sprinkler holes 33. Accordingly, the strong water stream in the form of a curtain can be formed around the first shower water 48, thereby surely preventing dispersion of the first shower water 48. As the outer sprinkler holes 38 are formed in the outer wall 32 of the sprinkler plate 16 which is increased in diameter in the flow direction, the second shower water 49 discharged from the sprinkler plate 16 can cover a larger area in proportion to a distance from the sprinkler plate 16.

In this manner, the second shower water 49 and the first shower water 48 can cooperatively discharge the shower water on a larger area of the user (e.g., on all over the user's body), which reduces shower time and promotes lower consumption of shower water, i.e., water-saving effects. Since the sprinkler cap 17 is detachably attached to the shower head body 12 by the screw mechanism 13, the area that the shower head 10 can wash can be easily and quickly changed by replacing the sprinkler cap 17 with a sprinkler cap having a different discharge angle of outer sprinkler holes.

Figure 6:
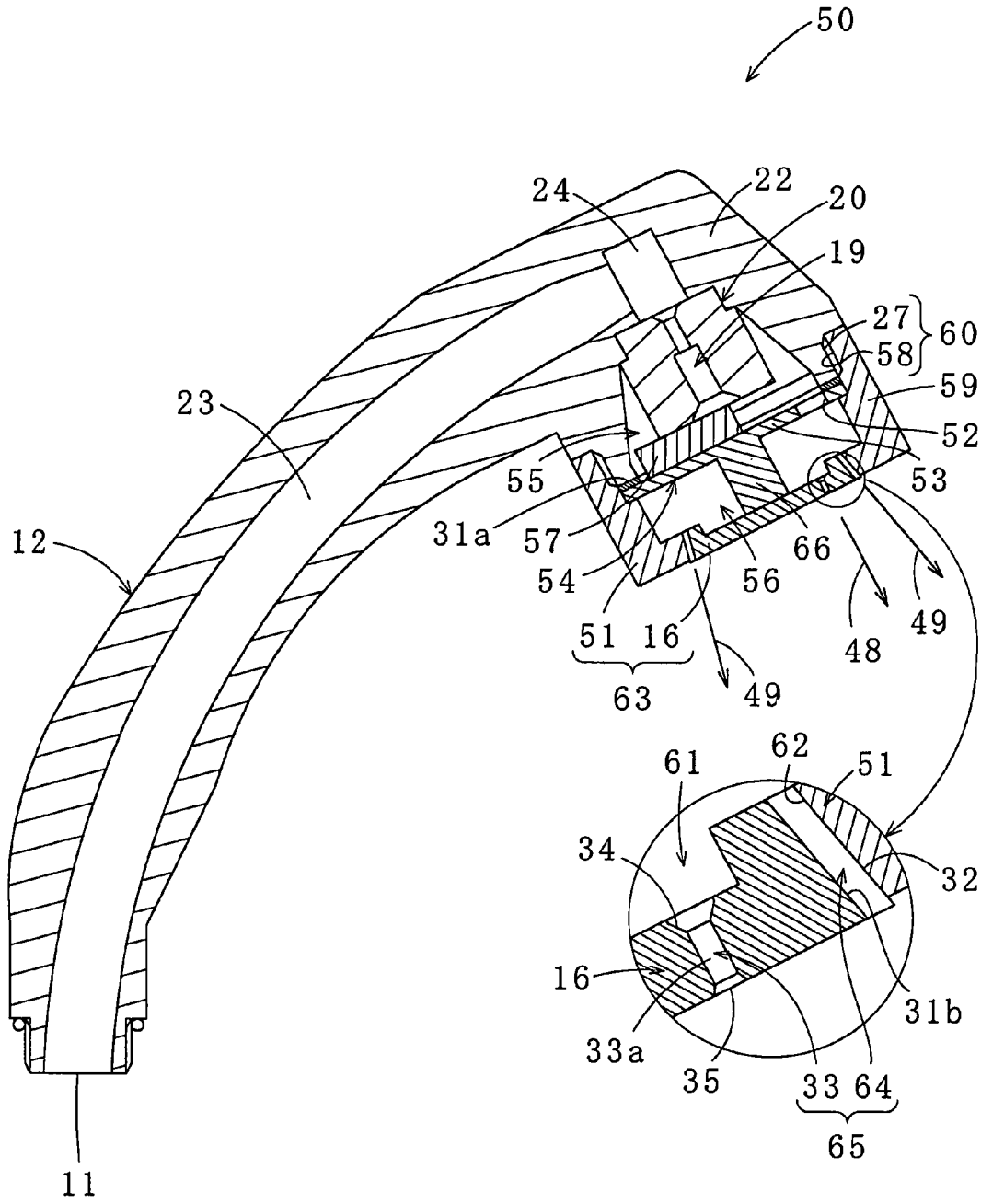
FIG. 6 is a sectional side view of a shower head according to a second embodiment of the present invention.
Figure 7:
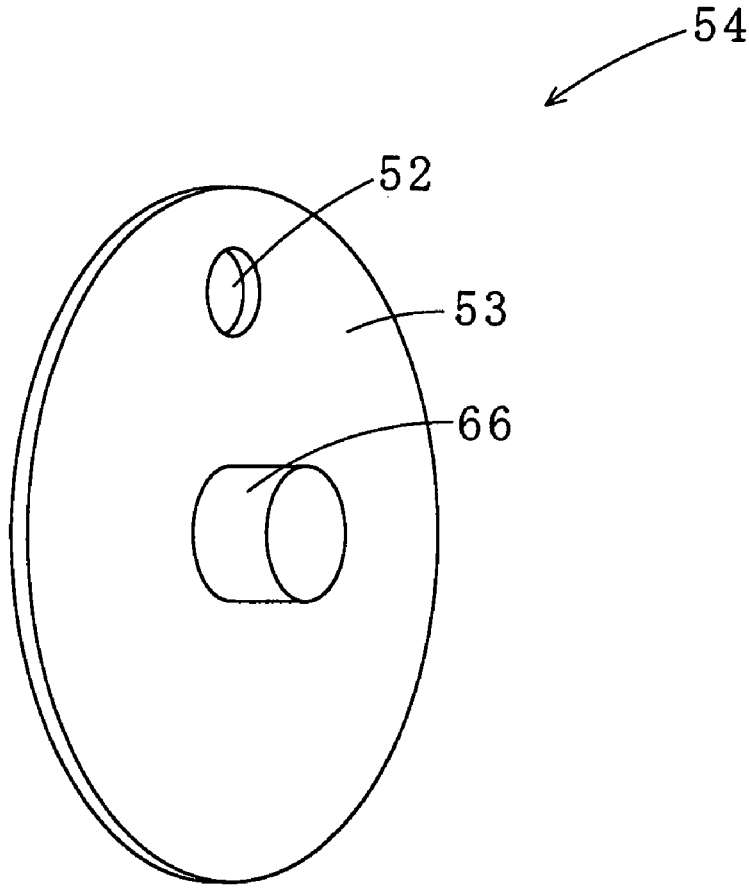
FIG. 7 is an illustrative view of a partition member of the shower head according to the second embodiment.

Referring to FIGS. 6 and 7, a shower head 50 according to a second embodiment of the present invention is explained. The shower head 50 is employed when pressure of the water supplied from the water inlet 11 is high. The shower head 50 lowers the discharge pressure of the water while maintaining the volume of the water, and discharges shower water having appropriate discharge pressure on the user when the shower is used. The same elements as those of the shower head 10 are provided with the same numbers, and detailed explanation thereof is omitted.

The shower head 50 differs from the shower head 10 in the following points: (1) a side wall portion 59 of a cap body 51, which is screwed to the male screw 27 of the shower head body 12, is longer than the side wall portion 28*a* of the cap body 14 of the shower head 10; (2) a partition member 54 having a partition plate 53 provided with a through-hole 52 is disposed between the flow control member 20 and the sprinkler plate 16 so as to form a first chamber 55 on the upstream side and a second chamber 56 on the downstream side; and (3) a silver ion generating material 57 in a solid form is disposed in the first chamber 55. Each of the components is explained in detail hereunder.

The side wall portion 59 of the cap body 51 has a female screw 58 provided on an inner wall of a proximal portion of the side wall portion 59, and is longer than the side wall portion 28*a* of the cap body 14 (e.g., about 1.8 times to 2.5 times). A screw mechanism 60 is constituted by the male screw 27 of the shower head body 12 and the female screw 58 of the cap body 51. The sprinkler plate 16 having the 5 inner sprinkler holes 33 and the 20 grooves 31*b* is fixedly secured to a fitting opening 61 which is increased in diameter in the flow direction and is formed in a central portion of the cap body 51 in a ring shape. The cap body 51 and the sprinkler plate 16 constitute a sprinkler cap 63. Twenty outer sprinkler holes 64 are formed by the grooves 31*b* of the sprinkler plate 16 and an inner wall 62 of the cap body 51. The inner and the outer sprinkler holes 33, 64 constitute sprinkler holes 65.

The partition member 54 is disposed between the shower head body 12 and the sprinkler cap 63 via the packing 31*a* positioned in the head portion 22 of the shower head body 12 in such a manner that the partition plate 53 may be perpendicular to the flow direction. The partition member 54 includes the partition plate 53 having the through-hole 52, and a columnar support 66 disposed substantially in the center of the partition plate 53 in the flow direction. A distal end portion of the support 66 is in contact with a center of the sprinkler plate 16 of the sprinkler cap 63 to prevent flexure of the partition plate 53 by water pressure generated by using the shower head 50. Alternatively, the support 66 may be omitted. The partition plate 53 substantially divides space formed by the downstream inside of the shower head body 12 and the upstream inside of the sprinkler cap 63 into two in the flow direction. Accordingly, the partition plate 53 forms the first chamber 55 on the upstream side where the flow control member 20 is disposed and the second chamber 56 on the downstream side thereof.

As the silver ion generating material 57 disposed in the first chamber 55, for example, a silver-coated porous ceramic pellet produced by combustion synthesis (e.g., "Daiginjo" made by Advance Co., Ltd.) may be employed. Water fed to the first chamber 55 from the diameter-reduced water passage 19 of the flow control member 20 is supplied to the second chamber 56 via the through-hole 52 of the partition member 54, and then discharged from the inner and the outer sprinkler holes 33, 64. In this instance, pressure in the first chamber 55 is reduced by water flow passing through the eccentric through-hole 52, cavitation is generated in the first chamber 55, and the water in the first chamber 55 goes into a state of boiling or near boiling while keeping its temperature and forms bubbles of steam. When the bubbles break subsequently, silver ions easily dissolve from the silver ion generating material 57. By the dissolved silver ions (including simultaneously generated hydroxy radical), shower water having sterilization effects can be obtained.

Next, a flow of water at the time of using the shower head 50 is explained.

When a faucet or a hot and cold water mixing faucet (not shown) is opened, water having a certain water pressure is supplied to the shower head 50 through a shower hose (not shown). Then, volume of the water is reduced and flow rate of the water is increased by the diameter-reduced water passage 19 of the flow control member 20. Furthermore, the water having passed through the diameter-reduced water passage 19 produces cavitation in the first chamber 55, and the water is sterilized by the silver ions which are dissolved from the silver ion generating material 57 by partly reduced pressure inside the first chamber 55. The water in the first chamber 55 is supplied to the second chamber 56 via the through-hole 52 of the partition member 54, and then is discharged out of the shower head 50 through the inner and outer sprinkler holes 33, 64 in the sprinkler cap 63. The water remained in the first and the second chambers 55, 56 can also be sterilized by the dissolved silver ions.

EXPERIMENTS

Experiments 1, 2

Experiments 1 and 2 conducted to confirm functions and effects of the shower heads according to the first and the second embodiments of the present invention are explained comparing with Comparative Experiments 1 and 2.

Flow volume, horizontal range from one meter height, and discharge pressure of shower water from nozzles were measured in Fukuoka Industrial Technology Center by using tap water having a temperature of 17.0° C. and a tap water pressure of 0.258 MPa and using the shower head 10 according to the first embodiment and the shower head 50 according to the second embodiment as Experiments 1 and 2, respectively. Table 1 shows the results.

Comparative Experiments 1, 2

Figure 5C:
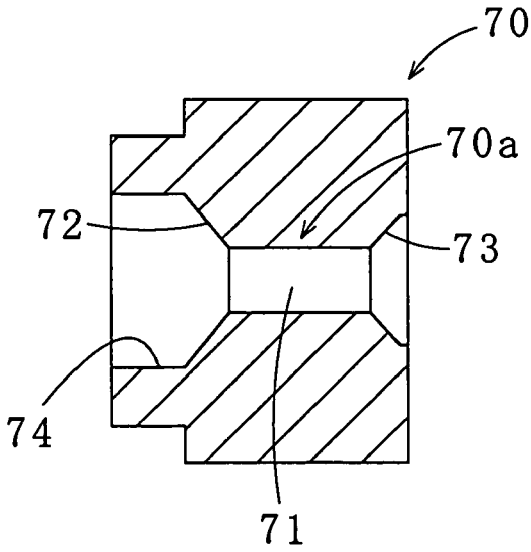

In Comparative Experiment 1, a shower head that was the same as the shower head 10 according to the first embodiment except that a flow control member 70 illustrated in FIG. 5(C) was employed instead of the flow control member 20 illustrated in FIG. 5(A) was used. A diameter-reduced water passage 70*a* of the flow control member 70 has a tapered diameter-reduced portion 72 reduced in diameter in the flow direction, a straight water passage portion 71 connected to the diameter-reduced portion 72, and a diameter-increased portion 73 which is increased in diameter in the flow direction and is provided on an exit side of the straight water passage portion 71. On an entry side of the tapered diameter-reduced portion 72, a straight portion 74 having a circular cross section is provided. The first water passage portion 40 of the flow control member 20 used in Experiment 1 has an inside diameter "d" of 3.6 mm, while the straight water passage portion 71 of the flow control member 70 used in Comparative Experiment 1 has an inside diameter of 5.8 mm (length thereof is about 10 mm). The straight portion 74 according to Comparative Experiment 1 has an inside diameter of 12 mm and a length of 5 mm, and the tapered diameter-reduced portion 72 has an inclined plane inclined at about 50 degrees to an axis of the straight water passage portion 71. The diameter-increased portion 73 also has an opening inclination angle of about 50 degrees to the axis, and a length of about 2.4 mm.

In Comparative Experiment 2, a shower head that was the same as the shower head 10 except the flow control member 20 was omitted was used.

Flow volume of shower water discharged from the shower heads according to Experiments 1, 2 and Comparative Experiments 1, 2 was measured by setting pressure of water supplied to the shower heads (i.e., supply pressure) at 0.05, 0.08, 0.10, and 0.15 Mpa. Table 2 shows the results.

TABLE 1

| | Experiment 1 | Experiment 2 | Comparative Experiment 1 | Comparative Experiment 2 |
|---|---|---|---|---|
| Flow volume (liter/min.) | 7.21 | 7.21 | 9.53 | 11.46 |
| Horizontal range (meter) | 2.5 | 2.0 | 2.4 | 0.5 |
| Discharge pressure (MPa) | 0.11 | 0.11 | 0.12 | 0.04 |

TABLE 2

| | Flow volume (liter/minute) | | | |
|---|---|---|---|---|
| Supply pressure (MPa) | Experiment 1 (%) | Experiment 2 (%) | Comparative Experiment 1 (%) | Comparative Experiment 2 |
| 0.05 | 4.5 (34.4) | 4.6 (35.1) | 6.2 (47.3) | 13.1 |
| 0.08 | 6.2 (36.7) | 5.9 (34.9) | 7.9 (46.7) | 16.9 |
| 0.10 | 6.9 (35.9) | 6.8 (35.4) | 8.8 (45.8) | 19.2 |
| 0.15 | 8.7 (35.5) | 8.6 (35.1) | 11.1 (45.3) | 24.5 |

As shown in Tables 1, 2, the shower heads of Experiments 1, 2 and Comparative Experiment 1 had lower flow volume and better water-saving effects than the shower head of Comparative Experiment 2 without a flow control member. The shower heads of Experiments 1, 2 had even better water-saving effects than the shower head of Comparative Experiment 1. In Table 2, values in parentheses represent flow volume ratios based on flow volume in Comparative Experiment 2 at the respective tap water pressure. The ratios were around 45% with the shower head of Comparative Experiment 1, whereas the ratios were around 35% with the shower heads of Experiments 1, 2. It was found that the shower heads of Experiments 1, 2 had better water-saving effects.

As shown in Table 1, compared with the shower head of Comparative Experiment 2, the shower heads of Experiment 1 and Comparative Experiment 1 had less flow volume, more water-saving effects, wider horizontal ranges of shower water, higher discharge pressure of shower water, and more powerful shower water. The shower head of Experiment 2 had less flow volume compared with the shower head of Comparative Experiment 2 and less powerful water compared with the shower head of Experiment 1. Therefore, it is found that the shower head of Experiment 2 can discharge shower water with an appropriate discharge pressure on the user when higher-pressure water is supplied (i.e., when connected to a high-pressure main valve).

Shower water discharged from the shower head of Experiment 2 contained 10 ppm of silver ions, and water in the first chamber contained 80 ppm of silver ions. After the silver ion generating material was immersed in 16000 liters of water for 24 hours, 40 ppb of silver ions were dissolved in the water. This shows that cavitation occurred in the first chamber of the shower head of Experiment 2, and reduced pressure in the first chamber allowed the silver ions to be dissolved from the silver ion generating material. Because of the dissolved silver ions, the discharged shower water had sterilization effects.

Although several embodiments have been described in detail herein with reference to the accompanying drawings, it is understood that the invention is not limited to these embodiments, and various changes and modification may be effected therein by one skilled in the art without departing from the scope or spirit of the invention as defined in the appended claims.

For example, the shower head body, sprinkler caps, and flow control members of the shower heads of the embodiments are made of ABS resin. Alternatively, these components may be formed by a synthetic resin such as PP, vinyl chloride, or PC (polycarbonate). In the embodiments, the each of the grooves formed on the outer wall in the periphery of the sprinkler plate has the U-shaped cross section. Alternatively, the each of the grooves may have an arc-shaped cross section opened radially outward. Furthermore, in the shower heads according to the present invention, a cross-sectional shape of the diameter-reduced water passage (e.g., the first and the second water passage portions) is not limited to a circle, and may be an ellipse, a polygon or any complicated shape except these shapes. In a case where the diameter-reduced water passage has a cross-sectional shape except a circle, given that a cross-sectional area thereof is "S", the inside diameter thereof "d" is calculated equivalently by a formula $d=2\cdot(S/\pi)^{1/2}$. The specific dimensions of the present invention are not limited to those in the present embodiments.

What is claimed is:

1. A shower head comprising:

a shower head body having a cylindrical water passage and an inflected water passage connected to the cylindrical water passage, the passages being provided inside the shower head body from a proximal portion thereof having a water inlet through a head portion thereof;

a sprinkler cap having a ring-shaped cap body and a sprinkler plate, the cap body having a fitting opening formed in a central portion of the cap body and being fixed to the head portion of the shower head body via a screw mechanism, the sprinkler plate having a plurality of sprinkler holes and being secured to the fitting opening; and a flow control member having a diameter-reduced water passage and being placed on an upstream side of the sprinkler plate;

wherein a partition plate having only one through-hole is disposed between the flow control member and the sprinkler plate to divide space therebetween into a first chamber and a second chamber, and said one through-hole is eccentrically disposed in the partition plate, wherein the sprinkler plate is made of a circular plate having an outer wall gradually increased in diameter in the flow direction and conforming to an inner wall of the cap body, and the sprinkler holes include a plurality of inner sprinkler holes and a plurality of outer sprinkler holes, the inner sprinkler holes being formed in an inner portion of the sprinkler plate except a periphery thereof and extending in parallel to an axis of the sprinkler cap, the outer sprinkler holes being formed by a plurality of grooves and the inner wall of the cap body, each of the grooves having an arc-shaped or a U-shaped cross section with an outer side thereof opened and being provided in the outer wall of the sprinkler plate.

2. The shower head according to claim 1, wherein a silver ion generating material in a solid form is disposed in the first chamber, and silver ions from the silver ion generating material dissolve in water discharged from the diameter-reduced water passage with the water flowing in the first chamber to be discharged from said one through-hole of the partition plate, thereby promoting sterilization of the water.

3. The shower head according to claim 1, wherein each of the inner sprinkler holes has a water entry portion and a water exit portion, the water entry portion being gradually reduced in diameter in the flow direction to be in a truncated conical shape, the water exit portion being gradually increased in diameter in the flow direction to be in a truncated conical shape.

4. The shower head according to claim 3, wherein each of the inner sprinkler holes has a straight portion having a length which is 0.6 to 1.2 times larger than a diameter of the straight portion.

5. The shower head according to claim 4, wherein the straight portion has an inside diameter of 0.35 to 0.8 mm.

6. The shower head according to claim 3, wherein the water exit portion has a taper angle of 30 to 45 degrees.

7. A shower head comprising:

a shower head body having a cylindrical water passage and an inflected water passage connected to the cylindrical water passage, the passages being provided inside the shower head body from a proximal portion thereof having a water inlet through a head portion thereof;

a sprinkler cap having a ring-shaped cap body and a sprinkler plate, the cap body having a fitting opening formed in a central portion of the cap body and being fixed to the head portion of the shower head body via a screw mechanism, the sprinkler plate having a plurality of sprinkler holes and being secured to the fitting opening; and a flow control member having a diameter-reduced water passage and being placed on an upstream side of the sprinkler plate;

wherein a partition plate having only one through-hole is disposed between the flow control member and the sprinkler plate to divide space therebetween into a first chamber and a second chamber, and said one through-hole is eccentrically disposed in the partition plate, wherein the diameter-reduced water passage has a first water passage portion and a second water passage portion respectively provided on an entry side and an exit side of the diameter-reduced water passage, the first water passage portion having a cross-sectional area smaller than those of the cylindrical water passage and the inflected water passage of the shower head body, the second water passage portion having an inside diameter which is 1.5 to 3 times larger than that of the first water passage portion; and a tapered diameter-reduced portion, reduced in diameter in a flow direction and communicated with the inflected water passage, is formed on an upstream side of the first water passage portion, and a diameter-increased portion increased in diameter in the flow direction is formed on a downstream side of the second water passage portion.

8. The shower head according to claim 7, wherein the first water passage portion has a length which is 1.3 to 2 times larger than the inside diameter of the first water passage portion.

9. The shower head according to claim 7, wherein a truncated conical connecting portion gradually increased in diameter in the flow direction is disposed between the first and the second water passage portions.

* * * * *